US009709222B2

(12) United States Patent
Bukkems et al.

(10) Patent No.: US 9,709,222 B2
(45) Date of Patent: Jul. 18, 2017

(54) LAMP AND LIGHTING FIXTURE

(71) Applicant: PHILIPS LIGHTING HOLDING B.V., Eindhoven (NL)

(72) Inventors: Peter Johannes Martinus Bukkems, Deurne (NL); Aldegonda Lucia Weijers, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 32 days.

(21) Appl. No.: 14/807,921

(22) Filed: Jul. 24, 2015

(65) Prior Publication Data

US 2016/0025274 A1 Jan. 28, 2016

Related U.S. Application Data

(63) Continuation of application No. PCT/EP2015/066062, filed on Jul. 14, 2015.

(30) Foreign Application Priority Data

Jul. 24, 2014 (EP) ..... 14178249

(51) Int. Cl.

| | |
|---|---|
| ***F21V 29/00*** | (2015.01) |
| ***F21K 99/00*** | (2016.01) |
| ***F21V 3/02*** | (2006.01) |
| ***F21V 7/00*** | (2006.01) |
| ***F21V 19/00*** | (2006.01) |
| ***F21V 3/04*** | (2006.01) |
| ***F21V 23/06*** | (2006.01) |
| ***F21K 9/23*** | (2016.01) |
| ***F21K 9/232*** | (2016.01) |
| *F21V 23/00* | (2015.01) |
| *F21Y 101/00* | (2016.01) |
| *F21Y 105/12* | (2016.01) |
| *F21Y 105/10* | (2016.01) |
| *F21Y 115/10* | (2016.01) |

(Continued)

(52) U.S. Cl.

CPC ..... *F21K 9/1355* (2013.01); *F21K 9/23* (2016.08); *F21K 9/232* (2016.08); *F21V 3/02* (2013.01); *F21V 3/04* (2013.01); *F21V 7/0016* (2013.01); *F21V 19/003* (2013.01); *F21V 23/06* (2013.01); *F21V 23/006* (2013.01); *F21Y 2101/00* (2013.01); *F21Y 2105/10* (2016.08); *F21Y 2105/12* (2016.08); *F21Y 2107/20* (2016.08); *F21Y 2107/90* (2016.08); *F21Y 2115/10* (2016.08)

(58) Field of Classification Search

CPC ..... F21K 9/1355; F21K 9/23; F21K 9/232; F21V 3/02; F21V 3/04; F21V 7/0016; F21V 19/003; F21V 23/06

See application file for complete search history.

(56) References Cited

U.S. PATENT DOCUMENTS

| | | | |
|---|---|---|---|
| 8,282,250 | B1 | 10/2012 | Dassanayake et al. |
| 2011/0235318 | A1 | 9/2011 | Simon et al. |

*Primary Examiner* — Thomas M Sember

(57) ABSTRACT

The present invention relates lamp (10), comprising: a carrier (12); a series (28*a*) of solid state light sources (30) mounted on the carrier; and a cover member (32*a*) covering the series of solid state light sources, wherein openings (40) are provided in the carrier between the solid state light sources of said series of solid state light sources, such that light emitted from the series of solid state light sources and reflected back towards the carrier by the cover member is allowed to pass the carrier through the openings. The present invention also relates to a lighting fixture comprising at least one such lamp.

20 Claims, 3 Drawing Sheets

(51) Int. Cl.
*F21Y 107/20* (2016.01)
*F21Y 107/90* (2016.01)

LAMP AND LIGHTING FIXTURE

CROSS REFERENCE TO PRIOR APPLICATIONS

This application is the Continuation Application under 35 USC 120 of International Application No. PCT/EP2015/066062, filed on Jul. 14, 2015, which claims the benefit of European Patent Application No. 14178249.0, filed on Jul. 24, 2014. These applications are hereby incorporated by reference herein.

FIELD OF THE INVENTION

The present invention relates to a lamp, for example a flat replacement bulb comprising light emitting diodes. The present invention also relates to a lighting fixture comprising at least one such lamp.

BACKGROUND OF THE INVENTION

CN202546362 discloses an LED (light emitting diode) lamp which i.a. comprises a lamp holder which is arranged at the bottom of a bulb; an LED circuit board arranged in the lamp holder; a vertically fixed LED lamp panel, wherein the LED lamp panel is electrically connected with the LED circuit board in the lamp holder through a rotating member; and a light guide sheet which is overlapped on the luminous surface of the LED lamp panel.

However, the light guide sheet in CN202546362 may reflect part the light emitted by the LED lamp panel back to the LED lamp panel, thus reducing the efficiency of the lamp Especially if the optical function of the light guide sheet is strong, the associated back reflection is increased. This lowers the efficiency of the lamp, which increases the cost of the lamp. Also, the light absorbed by the LED lamp panel increases the temperature of the LED lamp panel, which may reduce the life time of the lamp.

SUMMARY OF THE INVENTION

It is an object of the present invention to overcome at least some of the drawbacks mentioned above, and to provide an improved lamp.

According to a first aspect of the invention, this and other objects are achieved by a lamp, comprising: a carrier; a series of solid state light sources mounted on the carrier; and a cover member covering the series of solid state light sources, wherein openings are provided in the carrier between the solid state light sources of said series of solid state light sources, such that light emitted from the series of solid state light sources and reflected back towards the carrier by the cover member is allowed to pass the carrier through the openings.

The openings in the carrier increases the optical efficiency of the lamp, since light reflected back from the cover member otherwise may be absorbed in the carrier. Especially if the optical function of the cover member is strong (meaning strong light manipulation such as beam shaping or scattering), the associated back reflection is increased. Furthermore, since less or no light is absorbed in the carrier, the temperature of the carrier and the light sources may be lowered, which in turn may extend the life time of the lamp.

The lamp may further comprise a base for connection to a lamp socket, wherein the carrier is flat and arranged parallel to a longitudinal axis of the lamp. In this embodiment, the reflected light that is not absorbed directly by the carrier beneficially adds to the light output of the lamp in the correct direction. The carrier may have a perimeter including a base portion and a curved portion, wherein the series of solid state light sources and the openings are arranged along and follow the curved portion of the perimeter of the carrier. The cover member may have a flat central area surrounded by a hollow ridge extending along the curved portion of the perimeter of the carrier, which hollow ridge defines an optical chamber for the series of solid state light sources. The cover member may be translucent.

Said series of solid state light sources may be located on one side of the carrier, wherein another series of solid state light sources is mounted (and correspondingly located) on the opposite side of the carrier. In this embodiment, light generated on one side can mix with the light on the opposite side, thus improving the mixing behavior of the lamp.

The openings can facilitate color or flux mixing, reducing the requirements on the optical function of the cover member, which in turn may reduce the cost of the lamp. The lamp may further comprise another cover member covering said another series of solid state light sources, wherein the carrier is positioned between the two cover members.

A single opening may be provided between each two successive solid state light sources. Alternatively, several smaller openings could be provided between each two successive light sources.

The width of the openings may substantially correspond to the width of the solid state light sources. The width of the openings may for example be between 80% and 120% of the width of the solid state light sources. The length of the openings substantially may correspond to the distance between successive solid state light sources of said series of solid state light sources. The length of the openings may for example be between 80% and 100% of the distance between successive solid state light sources of said series of solid state light sources. Furthermore, the width and/or the length of the openings may be at least two times the thickness of the carrier. A purpose of the openings is to decrease the surface area of the carrier. However, the side walls of the openings increases the surface area, whereby the width and/or the length of the openings has/have to be large enough so that the overall surface area is decreased.

The carrier may be a single, separate, and self-supported carrier. In this way, the solid state light sources may easily be mounted on the carrier, preferably using conventional techniques, like surface-mount technology (SMT). The carrier may comprise electrical connections for the solid state light sources. The carrier may for example be a printed circuit board (PCB).

The solid state light sources of said (first) series may be arranged to emit light in directions towards said (first) cover member. Likewise, the solid state light sources of said another (second) series may be arranged to emit light in directions towards said another (second) cover member. The solid state light sources may be light emitting diodes.

According to a second aspect of the invention, there is provided a lighting fixture comprising at least one lamp according to the first aspect. This aspect may exhibit the same or similar features and technical effects as the first aspect of the invention.

It is noted that the invention relates to all possible combinations of features recited in the claims.

BRIEF DESCRIPTION OF THE DRAWINGS

These and other aspects of the present invention will now be described in more detail, with reference to the appended drawings showing embodiment(s) of the invention.

DETAILED DESCRIPTION

Figure 1:
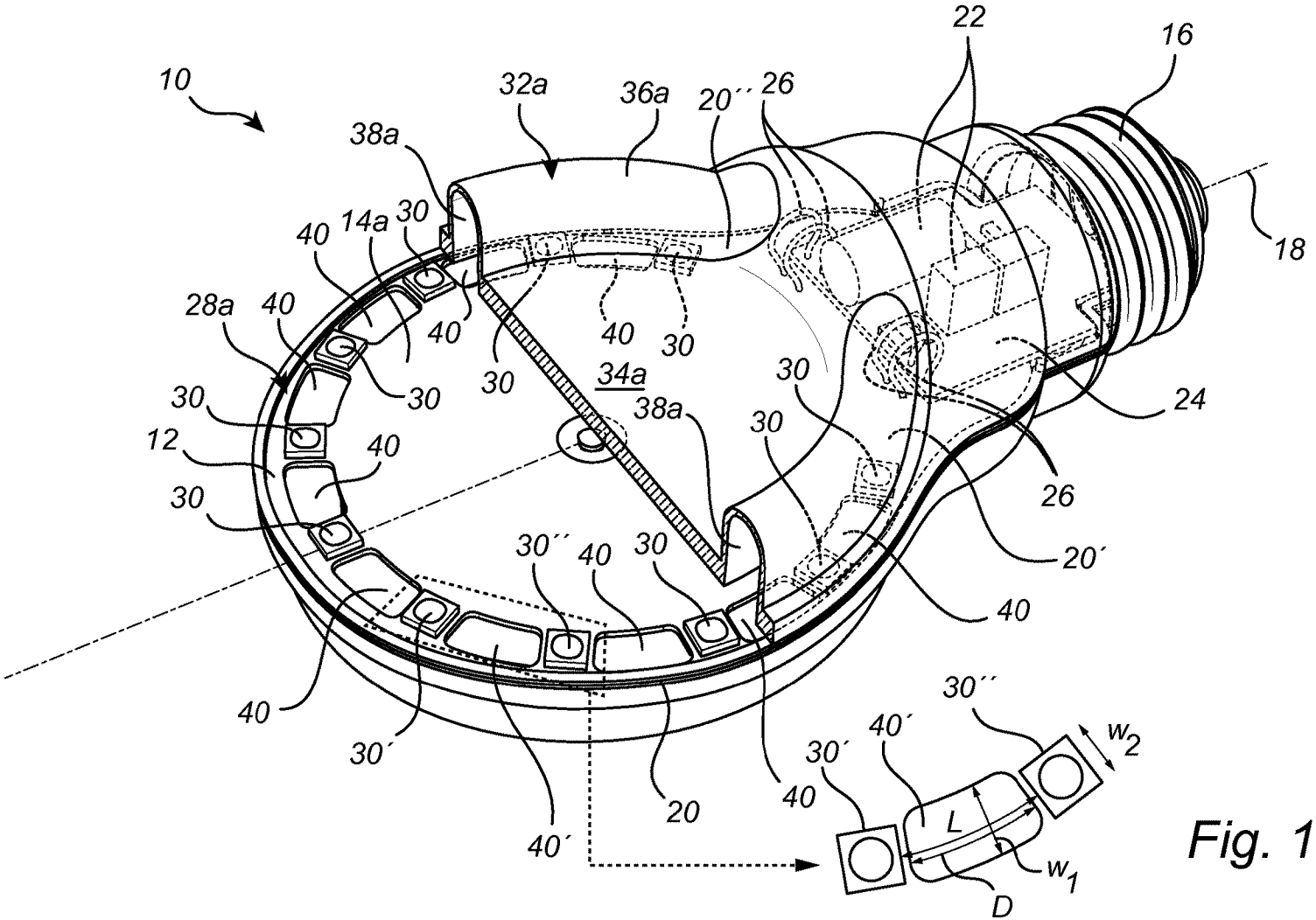
FIG. 1 is a perspective view of a lamp according to an embodiment of the present invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference numerals refer to like elements throughout.

Figure 2:
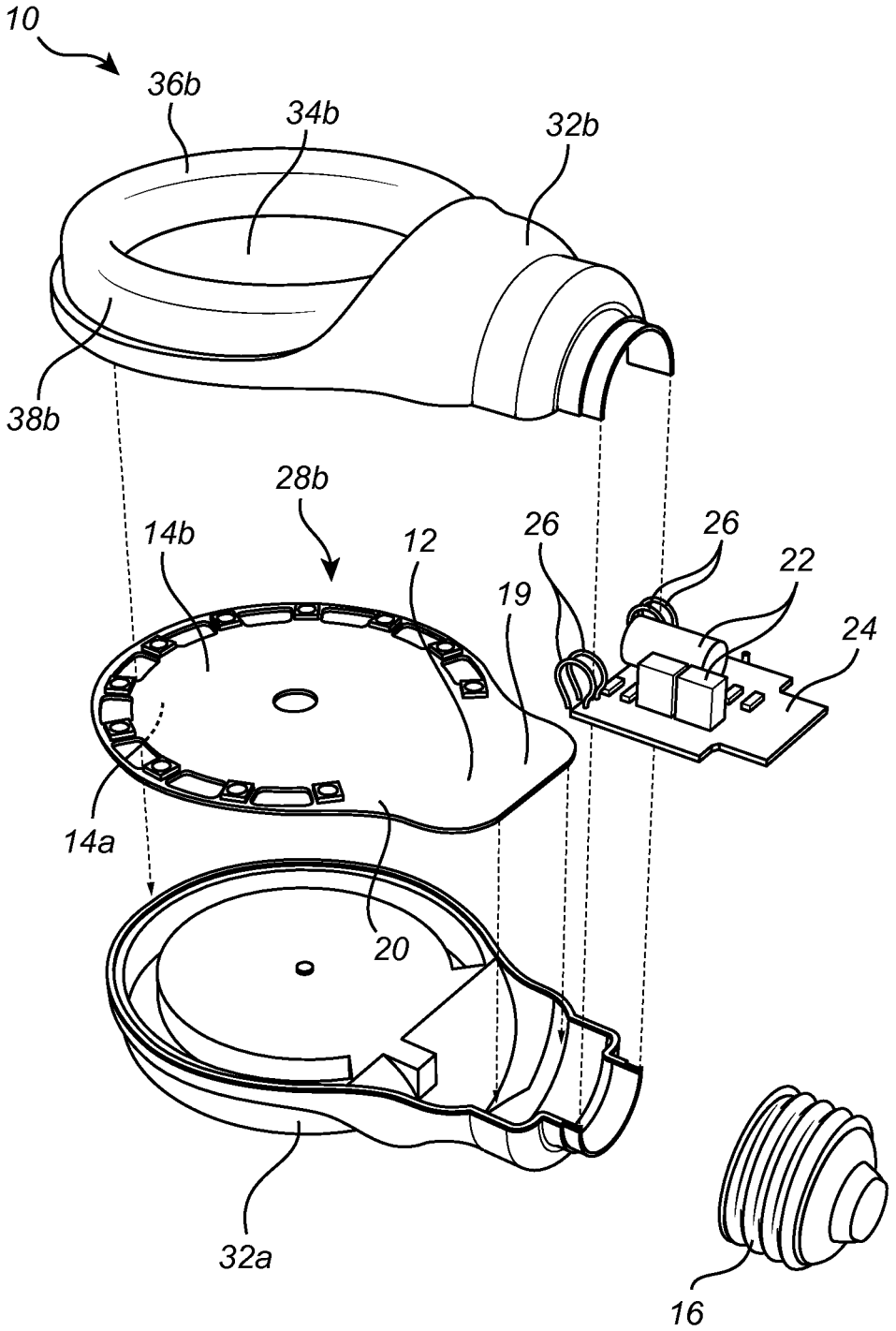
FIG. 2 is an exploded view of the lamp of FIG. 1.

FIGS. 1-2 show a lamp 10 according to an embodiment of the present invention. The lamp 10 comprises a carrier 12. The carrier 12 is preferably a single, separate, and self-supported carrier, though other configurations are possible as well. The carrier 12 is preferably flat, with a first side 14*a* and a second, opposite side 14*b*, as well as a thickness between the first side 14*a* and the second side 14*b*. The carrier 12 may be a printed circuit board (PCB), with electrically conductive tracks. The electrically conductive tracks may be on one or both sides 14*a*, 14*b* of the carrier 12, or they may be embedded in the carrier 12. Instead of being flat, the carrier may be twisted (not shown).

The lamp 10 may further comprise a base 16, for electrical and mechanical connection to a lamp socket (not shown). The base 16 may also be referred to as a fitting or end cap. Here, the base 16 is a single base. The base 16 may for example be a screw base with an external thread. However, the present lamp could have a different lamp base, such as bayonet, bi-pin, etc.

The carrier 12 is arranged substantially parallel to the longitudinal axis 18 of the lamp 14. Furthermore, the carrier 12 is preferably arranged in a fixed relationship relative to the base 16. The carrier 12 may have an edge or perimeter. The perimeter includes a base portion 19 facing the base 16. The perimeter further includes a curved portion 20. The curved portion 20 extends from 20' to 20" as indicated in FIG. 1. The curved portion 20 preferably mimics the silhouette of the glass of a traditional incandescent light bulb. The portion 20 may for example be curved like part of a circle, though other profiles are possible as well.

The lamp 10 may further comprise driver circuitry 22. The driver circuitry 22 may be arranged on a separate circuit board 24 connected to the carrier 12 via wires 26.

The lamp 10 further comprises a first series 28*a* of light sources 30 mounted on the first side 14*a* of the carrier 12. In FIG. 1, the first series 28*a* comprises eleven light sources 30, but the number of light sources of the series could be more or less. The light sources 30 of the first series 28*a* are arranged to mainly emit light in directions away from the first side 14*a* of the carrier 12. The light sources 30 may be solid state light sources (SSL), such as light emitting diodes (LED), OLEDs, PLEDs or the like. In FIGS. 1-2, the light sources 30 of the first series 28*a* are mounted along the curved perimeter portion 20 of the carrier 12. Thus, the first series 28*a* of light sources 30 is also arranged in a curved or arched manner. The light sources 30 of the first series 28*a* are connected to the electrically conductive tracks of the carrier 12, preferably in series.

The lamp 10 further comprises a first cover member 32*a* covering the first series 28*a* of light sources 30. In FIG. 1, a portion of the first cover member 32*a* is cut away just to more clearly show the underlying structure, but in the actual lamp 10 that portion is of course not cut away, see FIG. 2. Specifically, the first cover member 32*a* has a flat central area 34*a* surrounded by a hollow ridge 36*a*. The hollow ridge 36*a* has U-shaped cross-section. The hollow ridge 36*a* follows the curved perimeter portion 20 of the carrier 12, and defines an optical chamber 38*a* for the first series 28*a* of light sources 30. The first cover member 32*a* may be transparent or translucent, to allow to allow light from the light sources 30 to pass through. The first cover member 32*a* may also have an optical function, such as beam shaping or scattering, for example.

Furthermore, openings 40 are provided in the carrier 12 between successive light sources 30 of the first series 28*a*. The openings 40 are arranged along and follow the curved portion 20 of the perimeter of the carrier 12. The openings 40 further extend from the first side 14*a* of the carrier 12 to the second side 14*b* of the carrier 12. The openings 40 may therefore also be referred to as through-holes. The side walls of the openings 40 are preferably white/high reflective. Preferably, one opening 40 is provided between each two light sources 30, like opening 40' between light sources 30' and 30". In other words, the light sources 30 and the openings 40 are arranged in an alternated manner. Alternatively, several smaller openings could be provided between two successive light sources. The openings 40 are preferably open/empty spaces, but the openings 40 could alternatively be filled with a transparent material.

The width W1 of the openings 40 may substantially correspond to the width W2 of the light sources 30. The width W1 of the each opening 40 may for example be between 80% and 120% of the width W2 of a light source 30. Hence, the width W1 of the openings 40 may be somewhat smaller or larger than, or equal to (100%), the width W2 of the light sources 30. Likewise, the length L of the openings 40 may substantially correspond to the distance D between successive light sources 30 of the first series 28*a*. The length L of each opening 40 may for example be between 80% and 100% of the distance D. Hence, the length L of the openings 40 may be somewhat smaller than, or equal to, the distance D between subsequent light sources 30. In FIGS. 1-2, the openings 40 have an overall rectangular shape. They may also have rounded corners, and be slight curved in their longitudinal direction, to individually conform to the curved perimeter portion 20 of the carrier 12. However, other shapes of the openings 40 are possible.

Figure 3:
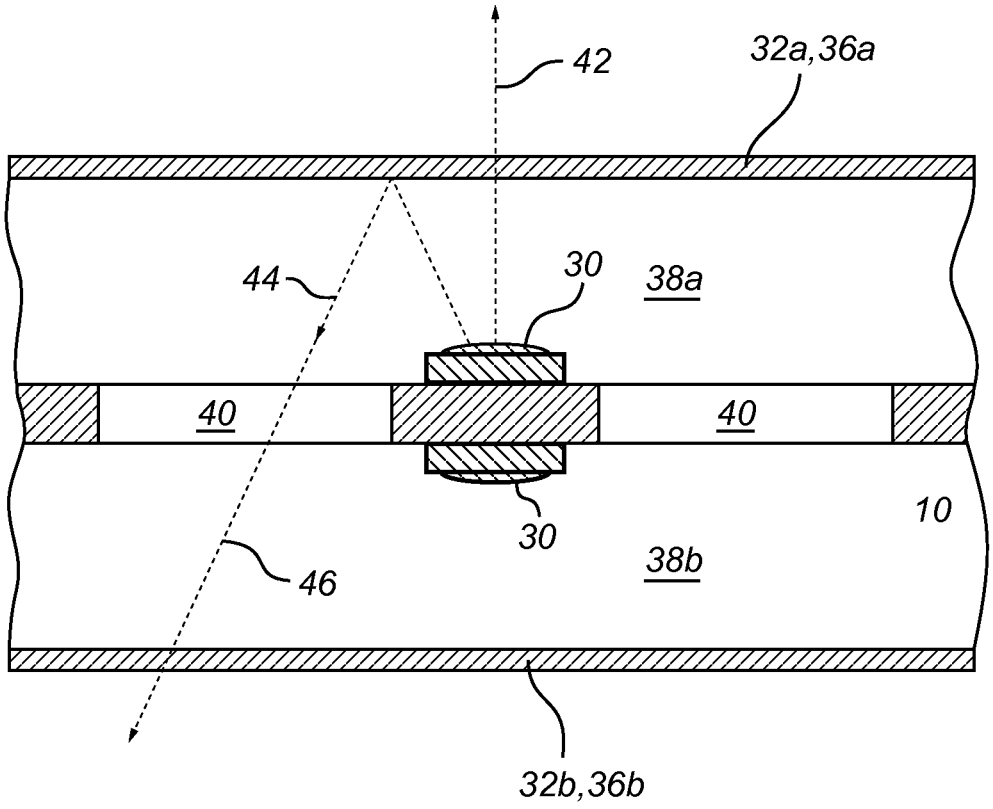
FIG. 3 is a partial cross-sectional side view of the lamp of FIGS. 1 and 2.

The lamp 10 may further comprise a second series 28*b* of light sources 30 mounted on the second side 14*b* of the carrier 12. The light sources 30 of the second series 28*b* are arranged to mainly emit light in directions away from the second side 14*b* of the carrier 12. The light sources 30 of the second series 28*b* are connected to the electrically conductive tracks of the carrier 12. Furthermore, the light sources 30 of the second series 28*b* may be located in the same positions on the second side 14*b* of the carrier 12 as the light sources 30 of the first series 28*a* are located on the first side 14*a*. In other words, the light sources 30 of the two series 28*a* and 28*b* are arranged "back-to-back", albeit with the carrier 12 in between, see further FIG. 3. In this way, the openings 40 are also present between successive light sources 30 of the second series 28*b*. The lamp 10 may further comprise a second cover member 32*b* covering the second series 28*b* of light sources 30, whereby the carrier 12 is sandwiched or positioned between the two cover members 32*a* and 32*b*. Like the first cover member 32*a*, the second cover member 32*b* has a flat central area 34*b* surrounded by a hollow ridge 36*b*. The hollow ridge 36*b* follows the curved perimeter portion 20 of the carrier 12, and defines an optical chamber 38*b* for the second series 28*b* of light sources 30. The second cover member 32*b* may be transparent or translucent, and it may also have an optical function. The two cover members 32*a* and 32*b* give the lamp 10 an overall flat shape.

In operation of the lamp 10, power is supplied from the lamp socket via base 16, driver circuitry 22, wires 26 and electrically conductive tracks of carrier 12 to the light sources 30, which thereby emit light. Light emitted from light sources 30 of the first series 28*a* is emitted into the optical chamber 28*a*. Most of the emitted light will pass through the first cover member 32*a* as indicated by arrow 42 in FIG. 3, to provide illumination, whereas some of the emitted light from the light sources 30 of the first series 28*a* will be reflected back towards the carrier 12 by the first cover member 32*a*, as indicated by arrow 44. The amount of light that is reflected back depends among other things on the optical function of the cover member 32*a*. For example, strong light manipulation such as beam shaping or scattering increases the back reflection. However, due to the openings 40, almost all light reflected from the first cover member 32*a* is transmitted to the other side of the lamp 10 where it gets "another chance" of escaping the lamp 10, through the second cover member 32*b*, as indicated by arrow 46. Likewise, some of the light emitted from light sources 30 of the second series 28*b* will be reflected back towards the carrier 12 by the second cover member 32*b*, but most of the reflected light is allowed to pass the carrier 12 through the openings 40 so that it can escape the lamp 10 through the first cover member 32*a*.

By means of the openings 40, the optical efficiency of the lamp 10 is improved. Furthermore, since less or no light is absorbed in the carrier 12, the temperature of the carrier 12 and the light sources 30 may be lowered, which in turn may extend the life time of the lamp 10. Furthermore, the light 46 beneficially adds to the light output of the lamp 10 in the correct direction. Furthermore, light generated on one side of the lamp 10 can mix with light generated on the other side of the lamp 10, thus improving the mixing behavior of the lamp. The openings 40 can facilitate color or flux mixing, reducing the requirements on the optical function of the cover member(s), which in turn may reduce the cost of the lamp 10.

The lamp 10 may for example be used in lighting fixtures or luminaires for illumination purposes. The lamp 10 may be used as a replacement or retrofit bulb in conventional lighting fixtures or luminaires.

The person skilled in the art realizes that the present invention by no means is limited to the preferred embodiments described above. On the contrary, many modifications and variations are possible within the scope of the appended claims. Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or an does not exclude a plurality. The mere fact that certain measures are recited in mutually different dependent claims does not indicate that a combination of these measured cannot be used to advantage.

The invention claimed is:

1. A lamp comprising:

a carrier;

a series of solid state light sources mounted on one side of the carrier; and a first cover member covering the series of solid state light sources, wherein said first cover member is transparent or translucent, wherein openings are provided in the carrier between the solid state light sources of said series of solid state light sources, such that light emitted from the series of solid state light sources and reflected back towards the carrier by the first cover member is allowed to pass the carrier through the openings to a second cover member arranged on the opposite side of the carrier, wherein said second cover member is transparent or translucent, said lamp further comprising a base for connection to a lamp socket, wherein the carrier is flat and arranged parallel to a longitudinal axis of the lamp.

2. The lamp of claim 1, wherein the carrier has a perimeter including a base portion and a curved portion and wherein the series of solid state light sources and the openings are arranged along and follow the curved portion of the perimeter of the carrier.

3. The lamp of claim 1, wherein a single opening is provided between each two successive solid state light sources.

4. The lamp of claim 1 wherein the width of the openings substantially corresponds to the width of the solid state light sources.

5. The lamp of claim 1, wherein the length of the openings substantially corresponds to the distance between successive solid state light sources of said series of solid state light sources.

6. The lamp of claim 1, wherein the width and/or the length of the openings is at least two times the thickness of the carrier.

7. The lamp of claim 1, wherein the carrier is a single, separate, and self-supported carrier.

8. The lamp of claim 1 wherein the carrier comprises electrical connections for the solid state light sources.

9. The lamp of claim 1, wherein the solid state light sources of said series are arranged to emit light in directions towards said cover member.

10. The lamp of claim 1, wherein the solid state light sources are light emitting diodes.

11. A lighting fixture comprising at least one lamp according to claim 1.

12. A lamp comprising:

a carrier;

a series of solid state light sources mounted on the carrier; and a cover member covering the series of solid state light sources, wherein openings are provided in the carrier between the solid state light sources of said series of solid state light sources, such that light emitted from the series of solid state light sources and reflected back towards the carrier by the cover member is allowed to pass the carrier through the openings, said lamp further comprising a base for connection to a lamp socket, wherein the carrier is flat and arranged parallel to a longitudinal axis of the lamp, wherein the carrier has a perimeter including a curved portion, wherein the cover member has a flat central area surrounded by a hollow ridge extending along the curved portion of the perimeter of the carrier, which hollow ridge defines an optical chamber for the series of solid state light sources.

13. The lamp of claim 12, wherein a single opening is provided between each two successive solid state light sources.

14. The lamp of claim 12, wherein the width of the openings substantially corresponds to the width of the solid state light sources.

15. The lamp of claim 12, wherein the solid state light sources are light emitting diodes.

16. A lamp comprising:

a carrier;

a series of solid state light sources mounted on the carrier, and a cover member covering the series of solid state light sources, wherein openings are provided in the carrier between the solid state light sources of said series of solid state light sources, such that light emitted from the series of solid state light sources and reflected back towards the carrier by the cover member is allowed to pass the carrier through the openings, said lamp further comprising a base for connection to a lamp socket, wherein the carrier is flat and arranged parallel to a longitudinal axis of the lamp, wherein said series of solid state light sources is located on one side of the carrier, and wherein another series of solid state light sources is mounted on the opposite side of the carrier.

17. The lamp of claim 16, further comprising another cover member covering said another series of solid state light sources, wherein the carrier is positioned between the two cover members.

18. The lamp of claim 16, wherein a single opening is provided between each two successive solid state light sources.

19. The lamp of claim 16, wherein the width of the openings substantially corresponds to the width of the solid state light sources.

20. The lamp of claim 16, wherein the solid state light sources are light emitting diodes.

* * * * *